United States Patent [19]

Becker

[11] 4,081,347

[45] Mar. 28, 1978

[54] APPARATUS FOR ELECTROPLATING METAL SURFACES, IN PARTICULAR CUT EDGES FORMED BY STACKING SHEET METAL PANELS CUT TO SIZE

[76] Inventor: Otto Alfred Becker, Robert-Koch-Str. 59, 66 Saarbruecken 6, Germany

[21] Appl. No.: 671,379

[22] Filed: Mar. 29, 1976

[30] Foreign Application Priority Data

Dec. 11, 1975 Germany ..... 2555800
Mar. 27, 1975 Germany ..... 2513885

[51] Int. Cl.[2] ..... C25D 17/14; C25D 21/04; C25D 21/10

[52] U.S. Cl. ..... 204/224 R; 204/129.46; 204/129.7; 204/261; 204/262; 204/266; 204/273; 204/274; 204/278; 204/239

[58] Field of Search ..... 204/224 R, 275, 276, 204/277, 278, 237-239, 258, 266, 273

[56] References Cited

U.S. PATENT DOCUMENTS

| | | | |
|---|---|---|---|
| 1,548,362 | 8/1925 | Holmboe | 204/258 |
| 2,590,927 | 4/1952 | Brandt et al. | 204/224 R X |
| 3,907,649 | 9/1975 | Becker | 204/224 R X |

FOREIGN PATENT DOCUMENTS

| | | | |
|---|---|---|---|
| 659,626 | 5/1965 | Belgium | 204/278 |
| 539,992 | 10/1941 | United Kingdom | 204/258 |
| 20,192 of | 1910 | United Kingdom | 204/239 |
| 136,994 | 8/1960 | U.S.S.R. | 204/239 |

*Primary Examiner*—John H. Mack
*Assistant Examiner*—D. R. Valentine
*Attorney, Agent, or Firm*—Donald D. Jeffery

[57] ABSTRACT

A substantially sealed electrolyte container is provided for electroplating articles, and an evacuating means is provided for evacuating the space above the electrolyte surface in the electrolyte container. The article to be electroplated forms the anode or cathode electrode. The electrolyte container is subdivided by porous partitions, which do not disturb the electrical field of force, into cathode and anode chambers, and separate gas extraction means are provided for said chambers. Beneath the electrolyte level in the cathode and anode chambers electrolyte extraction and supply means are provided by means of which the electrolyte is extracted, degassed and returned to the cathode and anode chambers.

26 Claims, 7 Drawing Figures

APPARATUS FOR ELECTROPLATING METAL SURFACES, IN PARTICULAR CUT EDGES FORMED BY STACKING SHEET METAL PANELS CUT TO SIZE

German patent application No. 1,771,645 describes an apparatus for electroplating metal surfaces, in particular cut edges formed by stacking metal panels cut size, in which the articles bearing said metal surfaces cannot be introduced into a container filled with electrolyte because of their size or form or for other reasons. This is particularly true in the case of cut edges of metal panels cut identically to size and consisting for example of steel. For this reason, in the aforementioned application one of the vertical walls of the electrolyte container is made as porous wall from a liquid-permeable absorbent material, such as felt, spongy substances, foam materials, or the like. The metal surfaces to be electroplated are pressed against said porous wall and can thus be electroplated without having to be introduced into the electroplating container. To avoid excessive loss of electrolyte from the electroplating container, in this known electroplating apparatus the upper portion of the electrolyte container is sealed in air-tight manner from the outside, the air being extracted from the air space at a predetermined rate by an air pump.

It is also already known (U.S. Pat. No. 2,465,747) to evacuate the air space above the electrolyte surface in an electroplating container with the aid of a vacuum pump, the electroplating container also being otherwise completely sealed. This evacuation has the advantage that gas bubbles formed at the article to be electroplated are largely removed and the quality of the electroplate coating improved. However, the oxygen and hydrogen quantities in electroplating depend very much on the electrolyte used and the electrodes and there is therefore a danger that the extracted gas mixture will give the dangerous oxyhydrogen mixture which is highly explosive.

The invention is based on the problem of providing an apparatus of the type mentioned at the beginning with which the quality of the coatings produced on the metal surfaces to be electroplated is still further improved and there is no danger of the formation of oxyhydrogen detonating gas.

According to the invention this problem is solved in that the electrolyte container is subdivided by porous partitions which do not disturb the electrical field of force into cathode and anode chambers, that separate gas extraction means are provided for said chambers and that beneath the electrolyte level in the cathode and anode chambers electrolyte extraction and supply means are provided via which the electrolyte is extracted, degassed and returned to the cathode and anode chambers.

This further development of the apparatus achieves a complete separation of the gases produced during electroplating and at the same time greater removal of said gases from the electrolyte, thus improving the quality of the electroplate coating produced because fresh electrolyte is constantly supplied to the electrodes due to the continuous electrolyte extraction and return.

According to an advantageous further development of the invention separate electrolyte extraction and supply means are provided, the extraction means being connected to separate degassing means and the electrolyte freed from gases in the degassing means being conducted into a storage container from which the electrolyte supply means are fed.

The partitions prevent the passage of the used electrolyte layers with the gases dissolved therein. These partitions may for example consist of plastic sheets which are perforated in grid-like manner and carry on one or both sides porous walls of adapted density without disturbing the electrical field in any manner. Preferably, at least two such partitions are used in spaced relationship. The intermediate space receives fresh electrolyte from the electrolyte storage container via a supply hose, a regulating device and a suction-pressure pump. This unused electrolyte penetrates through the porous partitions both to the cathode and to the anode and displaces the used layers forming on the electrodes and the polarizations effected thereby.

This movement of the electrolyte against the polarized layers is permitted by a regulatable draining or discharge, e.g. downwards, for example in collection troughs arranged separately and air-tight. The electrolyte used up at the electrodes and enriched with dissolved gases is led off separately for the two electrodes.

These separately removed electrolytes may be freed from the gases dissolved therein via separate degassing means and then returned to the supply container, which ray have further means for degassing separately for both gases. An advantage of this electroplating apparatus is that the reciprocal movement thereof along the cathode surface makes the formation of diffusion layers at the phase boundary between cathode and electrolyte impossible or almost impossible. This remedies one of the factors which impair a high-quality smooth nonporous firmly adhering metallic layer; in particular no concentration polarization can form, i.e. a depletion of the metal ions and hydrogen excess voltage at the cathode. The exclusion of such concentration and diffusion polarizations is decisive for the quality of the structure of the deposited metal. The obviation of the polarizations permits a higher migration velocity of the ions. The decisive factor as regards the time required to obtain a predetermined deposit is the current density. Due to the greater hydrogen development said density must not exceed a predetermined extent because otherwise rough lumpy porous layers are deposited. The necessary rapid removal of the hydrogen is effected by the evacuation of the electroplating container and the circulation and degassing of the electrolyte. This allows higher current densities to be used without forming such rough and lumpy deposits. An additional contributory factor is the vigorous electrolyte movement in the electroplating container, further details of which will be described in the following description. if socalled inhibitors (organic chemical compounds) are added to the electrolyte to reduce the excess voltage at the cathode, these inhibitors are supplied more quickly and more concentrated to the cathode due to the greater electrolyte motion. Such inhibitors govern the fine grainness of the deposit and thus the gloss of the coatings and their ductility. An optimum electrolyte movement is a decisive factor for accelerating the layer exchange at the electrodes and thus for the quality of the electroplating.

According to a further advantageous development of the invention the electrolyte extraction means open from the cathode or anode chamber into degassing means formed by vacuum vessels in which the gas formed is separated from the entrained electrolyte constituents.

A further improvement of the invention as regards removing the gas bubbles forming at the electrode results from the fact that the anode electrode and/or the article to be electroplated forming the cathode electrode are set in oscillation. It is also advantageous to set the electrolyte in the supply container in oscillation. These oscillations may advantageously be ultrasonic ones.

According to a preferred further development of the invention the electroplating container is constructed as electroplating strip moveably disposed above the metal surface to be electroplated, the open side surface of said strip being smaller than the surface to be electroplated. In the electroplating strip at least one porous partition is then disposed which is arranged parallel to the metal surface and disposed between the anode electrode and the metal surface to be electroplated, a permanent electrolyte flow being maintained in the electroplating strip by the electrolyte extraction and supply means.

It is advantageous for the open side surface of the electroplating container to be covered by a porous wall which comprises a surface directed towards the metal surface to be electroplated and provided with vertical corrugated recesses.

The reciprocal movement of the electrolyte container, which is constructed in the form of an electroplating strip whose corrugated porous outer surfaces are pressed in air-tight manner against the cathode surface, increases the possibility of preventing by its movement polarizations, in particular the concentration polarization and diffusion polarization, and of stripping from the cathode surface the hydrogen gas depositing more rapidly due to a possibly higher current density.

The electroplating means is accommodated together with the article to be electroplated in a dismountable airtight sealed pressure-resistant evacuatable housing formed from vertical side wall portions and an air-tight cover.

A vacuum is advantageously produced in this cavity. For this purpose corresponding evacuating pipes communicating via valves with evacuating means open into said cavity at suitable points.

The reciprocal movement of the electroplating strip produces on the surface of the pile a thin electrolyte layer which during the movement of the electroplating strip is exposed for short periods in the evacuated cavity. This obviates any liquid pressure which electrolyte liquids otherwise exert jointly with the atmospheric pressure on the articles to be electroplated introduced into said liquids. These factors are favourable. Coatings of the highest quality can be produced. In particular, it is possible to obtain electroplated coatings which are pore-free, find-grained, smooth, of any desired thickness and of very high adhesion.

Of course, coatings of coarse-grain and less smooth layers may also be produced if desired and these are then still pore-free and of very high adhesion. The ductility or hardness and the duration of the electroplating may also be varied inter alia by using higher current densities. All the gases liberated at the electrodes can be separated under the vacuum without first being united to form relatively large gas bubbles as is the case with an electrolyte to overcome the pressure acting thereon; the hydrogen ions can as it were escape in the molecular gaseous state. This is essential for the formation of a stainless sealed pore-free surface and high bonding strength of the electroplated layer and to enable higher current densities to be used.

As is apparent from the following description in addition to these requirements resulting from the formation and movement of the electroplating strip and the vacuum in which the article to be electroplated is disposed, favourable conditions are present from the start in the electroplating strip with regard to the anode. All these factors combine together to permit high quality of the electroplating.

The invention also provides for arrangement in said evacuated cavity of for example infra-red radiation by which the cathode surfaces over which the electroplating strip brushes may be heated to an optimum temperature. Such increased temperatures are also advantageous for the gaseous liberation of the hydrogen at the cathode.

The mobility of the ions in the electrolyte increases. Also, oxidation cannot occur due to removal of the air, which would form chemical covering layers on the surface of the articles to be electroplated. The use of higher current densities also becomes possible. This considerably influences the nature of the structure of the deposit, as does the removal of hydrogen bubbles by electrolyte motion.

The electrolyte supplied to the electroplating strip can have already a predetermined working temperature of optimum magnitude. For this purpose, electrical heating devices may for example be provided in the electrolyte supply container.

Furthermore, the corrugated layer may be formed in such a manner that it is discharged in an amount progressively decreasing downwardly onto the surface to be electroplated corresponding to the height of the electroplating strip or surface. This is to obtain maximum uniformity of the layer thickness. The electrolyte liquid amounts discharged in the lower portions are supplemented by the electrolyte flowing down from above onto the surface.

If expedient, the anode may be divided into a suitable number of horizontal sections which are insulated from each other and these individual sections subjected for example to voltages decreasing progresively from the top to the bottom. Instead of a uniform electrical field this produces a plurality of fields of different current densities which act on the electrolyte in spatial superposition, for instance continuously increasing upwardly or adapted to the specific requirements. This makes it possible if necessary to vary the deposits on the corresponding horizontal sections of the cathodic surface to be electroplated.

The resilient rims of the electroplating strip, for example consisting of rubber, may also be provided with marginal slits or ribs or the like whose width and size can also be utilized to effect for example a discharge of the electrolyte from the electroplating strip in an amount decreasing progressively downwardly. The discharging electrolyte may be led into collection troughs and after degassing from hydrogen to the electrolyte supply container.

The speed of the movement of the electroplating strip is regulatable as is its application pressure and the amount of electrolyte discharged. Such electroplating strips may for example be adapted to curved cathode surfaces.

Instead of providing the electroplating strips with porous corrugated outer surfaces they may have different outer surfaces, such as soft brush hairs.

Alternatively, spray nozzles may be incorporated into the brush-like contact surface of the electroplating srtip to impregnate the brush with fresh electrolyte.

Also, spray nozzles directed only towards the cathode surface may be provided in the electroplating strip to form a continuous electrolyte covering on the cathode surface. This does not interrupt the electrical field.

A further possibility is for example to provide a rotating electroplating strip. These various possibilities as regards the formation and type of movement of the electroplating strips depend on the article to be electroplated and its shape. Such electroplating strips may be arranged simultaneously on all sides of the article to be electroplated and conduct the entire electroplating simultaneously. The cathode current can be supplied to the article to be electroplated from any suitable point.

If the article consists of a plurality of parts insulated from each other, as is the case for example of panels coated on both sides with plastics or lacquers, the cathode current must be supplied to each individual insulated part. This can be done in the manner described for example in specification as laid open to inspection P 18 03 474.

To prevent electrolyte flowing between the superposed panels, in the case for example of uncoated panels the edge portions may be sealed by adhesive tapes. The electrolyte can then only wet the cut edges.

The guide of the electroplating strip is illustrated in the example of embodiment at the housing walls. It may also be arranged on a frame within the housing or in any other suitable manner, for example on the covering plates which rest on the pile and serve to press the pile panels against each other by pressures means.

The electroplating strips may be applied by compressed-air means.

This electroplating apparatus is also suitable for anodizing. The article is then the anode at the same time. The cathode is then incorporated into the electroplating strip. The outer dismountable housing may be sealed in air-tight manner, the air moved and oxygen introduced in its place.

All the steps necessary for anodizing aluminium sheets and aluminium bodies and the like may be applied analagously with the means described herein and the method steps set forth. Because of this great variety of possibilities the apparatus according to the invention is of general significance. With this apparatus, by exchanging the elctroplating strips the articles to be electroplated may for example be cleaned in advance to prepare for the electroplating. Also, for example, chromatisation may be carried out of inter alia zinc-plated type edges. Any necessary aftertreatment may also be carried out with apparatuses of this type. Lacquers and the like may for example be applied by replacing the elctroplating strips by lacquering strips with brushes and/or spray nozzle fittings.

The obviation of concentrating polarizations, hydrogen excess voltages, diffusion layers and the like can advantageously be effected by mechanical oscillations exerted on the electroplating strips by electromagnets associated therewith. For this purpose, the electroplating strips may be made resiliently oscillatable, for example mounted in rubber.

The electroplating strip then not only executes the reciprocal movement but simultaneously oscillations or vibrations in the directions which are optimum for the particular electroplating. The article to be electroplated itself may also execute oscillations. It may rest for example on an oscillatable resilient base, for example of rubber, and the oscillations produced by for example electromagnets. These oscillations of the pile or article may for example be combined with the oscillations of the electroplating strip.

A degassing of the electrolyte layers applied on the surfaces to be electroplated and also for the electrolyte within the electroplating strip may be conducted very intensively by ultrasonic vibrations in the degassing means inter alia also in the electrolyte supply container. This produces simultaneously a depolarization, layer exchange (diffusion layers) and intensification of the ion movement. In particular, for this purpose magnetostrictive and piezoelectric ultrasonic generators may be used with which not only the electrolyte may be set in oscillation but also the article to be electroplated, regardless of its form or whether it is mounted inside the electroplating apparatus or outside via a porour partition. These oscillations compel the gases dissolved in the electrolyte to form bubbles. The electrolyte is purified by the liberation of gases. With very high tensile stresses produced by ultrasonic means, in the electrolyte with the gases dissolved therein cavities may be formed which also instantaneously effect the separation of the gases. The ultrasonic energy may be supplied not only via the electrolyte in the electroplating strip but in a similar manner via the electrolyte in the supply container.

It is also advantageous to provide corresponding vibrating porous means bearing on the anode surfaces. The for example sheet or rod anodes themselves may be set in vibration to facilitate the rapid and complete escape of the oxygen depositing thereon. The physical laws governing the process mean that the position of the gases at anode and cathode are in a ratio of 1 oxygen atom to 2 hydrogen atoms and consequently inhibition of the deposition of the oxygen gas at the anode simultaneously inhibits a corresponding deposition of hydrogen and metal at the cathode. It is therefore essential, both for the anode and for the cathode, to provide means for increased separation of the gases and the metal to increase the rate and improve the electroplating operation.

The invention will be explained hereinafter with reference to examples of embodiment illustrated in the drawings wherein.

Figure 1:
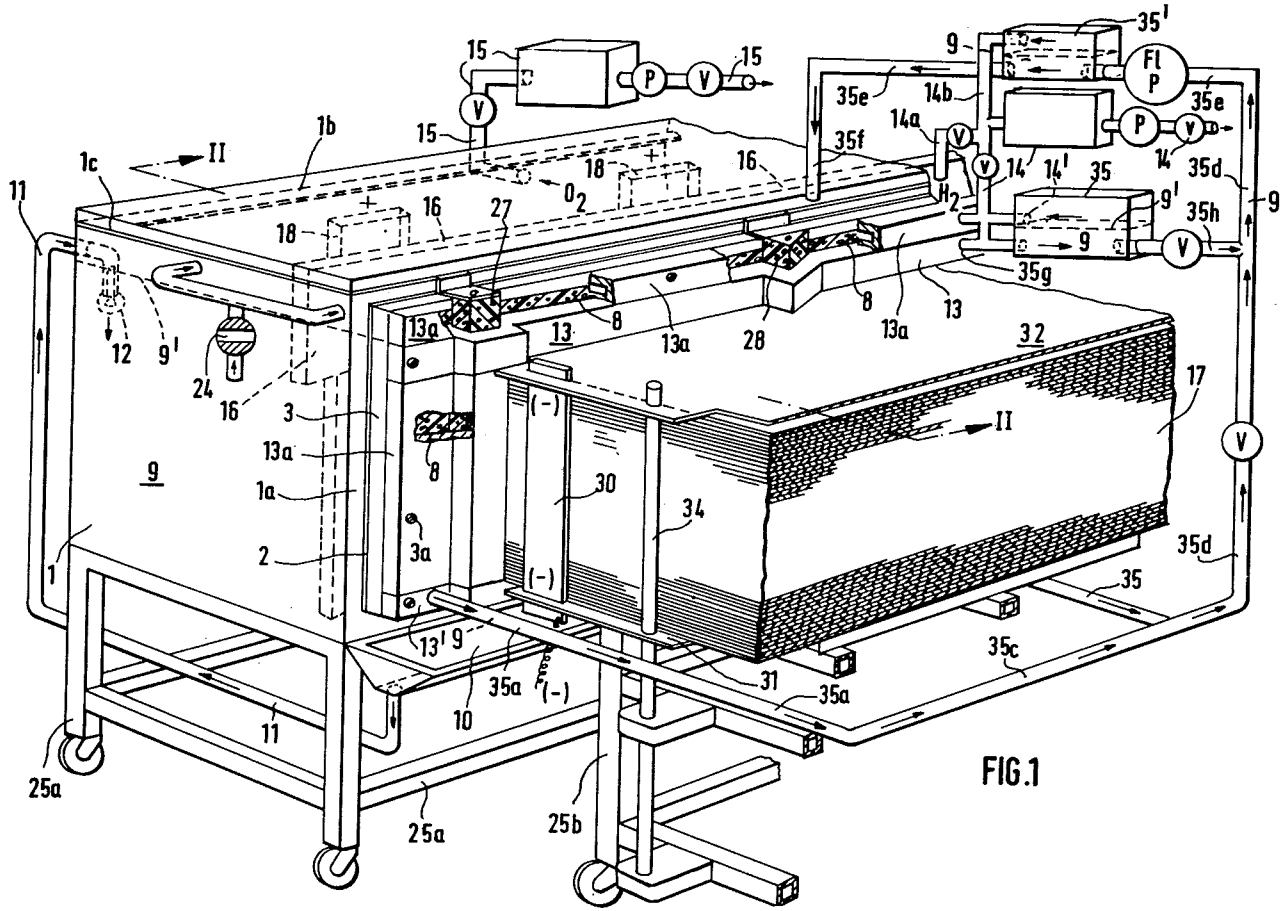
FIG. 1 is an embodiment of the apparatus for electroplating the cut edges of a panel pile.
Figure 2:
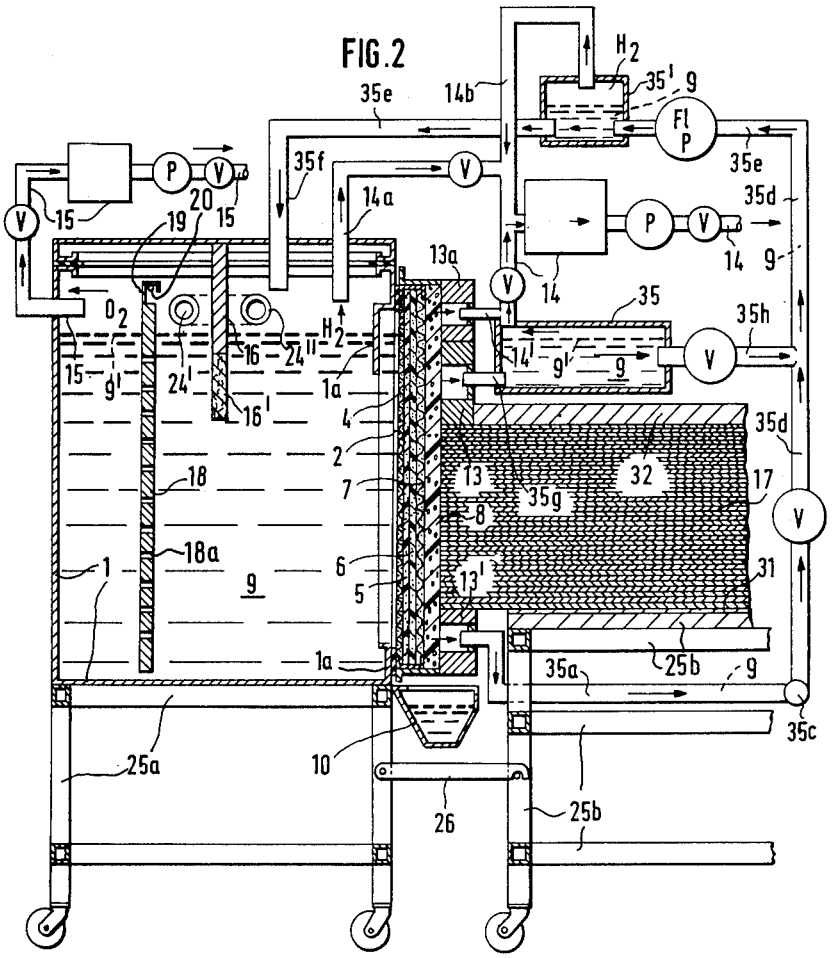
FIG. 2 is a section along the line II—II of FIG. 1.

FIG. 1 shows in perspective an electrolyte container 1 whose perpendicular long side wall is open except for an encircling frame member 1a. Mounted on this frame member 1*a* is a rubber seal 2 on which a support frame 3 is detachably secured, for example with screws 3*a*. Mounted in said support frame 3 towards the inside of the container (cf. FIG. 2) is a sieve-like wire grating 4 and on the latter there is arranged an absorbent side wall panel 5 and then an absorbent panel 6 which have different degrees of permeability for the electrolyte; there then follows a further sieve-like wire grid 7 in front of which a further absorbent side wall panel 8 is disposed.

The electrolyte container 1 is sealed in air-tight manner with a lid 1*b* with interposition of a rubber seal 10. The electrolyte is introduced up to a predetermined level 9 into the electroplating container. Electrolyte ia also introduced into a collection trough 10 which is disposed beneath the support frame 3 and connected by a conduit 11 to the upper portion of the electroplating container. The end of the conduit 11 opening into the electroplating container carries a float valve 12. If the level of the electrolyte drops the float valve opens and closes again when the electrolyte level 9 rises. Since the air above the electrolyte surface is drawn off with means still to be described to limit the amount of electrolyte discharging from the side wall panels 5, 6, 8 of the support frame 3, when the float valve 12 is opened the electrolyte disposed in the collection trough 10 will be sucked into the container 1 until the valve closes again.

The electrolyte container 1 is mounted on a travelling table 25*a*. It is pressed with the latter against a pile of metal sheets 17 whose cut edges lie in a common vertical plane so that the absorbent side wall panel 8 transmits the electrolyte discharging to the pile surface.

The pile 17 is connected to the negative pole of a direct current source and thus forms the cathode at which the electrolyte metal deposits. The galvanic current flows from the cathode 17 (pile) to the anode metal sheets 18 which are provided parallel to the open side of the container 1 suspended in the electrolyte in a manner known per se with hooks 19 on current carrying bars.

The pile 17 is placed on a travelling table 25*b* and projects all round over the table support legs to an extent such that the collection through 10 is sufficiently beneath the pile.

The two travelling tables 25*a* and 25*b* may be connected together for example by pivot arms 26 (FIG. 2) or tension springs to give uniform application of the side wall panel 8 against the vertical pile face.

The cut edges may be interrupted by punchings which serve for subsequent turning up of the edges. These cut edges projecting into the pile are simultaneously electroplated by vertical electroplting strips 27, 28 which correspond in form to the punchings and are attached for example by clamping to the frame 3; said strips carry absorbent means facing the punchings and the side wall panel 8 and these means take over electrolyte from the side wall panel. With large punchings these electroplating strips may also accommodate in their interior anode rods or the like about which sieve-like tubes 23 are placed so that liquid electrolyte flows round the anode rods and the gases liberated arise along the anode.

The pile 17 consists for example of sheet metal panels provided with plastic, lacquer or other insulating material. It is thus necessary to supply the cathode current to eaach individual panel. This is done by a contact strip 30 which may for example be constructed as copper wire brush. The contact brushes 30 may be brought into intensive contact with the cut edges of the pile by resilient means or by vibrating electromagnets.

According to the invention the support frame 3 mounted resiliently on the rubber seal 2 is set in oscillations in the longitudinal direction of the container opening by AC electromagnets, thus producing intensive contact of the side wall panel 8 with the surface of the pile to be electroplated. Such vibrations may be produced in any direction with respect to the pile face by additionally provided elctromagnets.

The electrolyte in the phase boundary is also set in oscillation. Such oscillations can be made more intensive by ultrasonic means. In particular, for this purpose magnetostrictive and piezoelectric ultrasonic generators may be used with which not only the electrolyte can be set in oscillation but also the article to be electroplated, irrespective of its shape and whether it is mounted within the electroplating apparatus or outside via a porous partition. These oscillations compel the gases dissolved in the electrolyte to form bubbles so that the electrolyte is purified by liberation of the gases. With very high tensile stresses produced by ultrasonic means in the electrolyte with the gases dissolved therein cavities can arise which also instantaneously effect the separation of the gases. The ultrasonic energy can be supplied not only via the electrolyte in the electroplating container but in the same manner via the electrolyte in any supply container provided, as further explained with the aid of FIG. 3.

Vibrating porous means bearing on the anode surfces may also be provided for the anodes 18 and/or the latter themselves may be set in oscillation to facilitate the escape of the oxygen liberated. Since by the laws of physics the deposition of these gases at the anode and cathode is in the ratio of 1 oxygen atom to 2 hydrogen atoms, an inhibition of the separation of the oxygen at the anode simultaneously inhibits the separation of the equivalent amount of hydrogen and metal at the cathode. Accordingly, it is advantageous to provide both for the cathode and for the anode means for improved separation of the gases and for the electrolyte metal for an optimum increase in the rate and improvement of the electroplating operation.

According to the invention, upper and lower suction strips 13, 13*a*, 13' are provided above and beneath the pile respectively. These suction strips include resilient sealing means sealed in air-tight manner with respect to the outside between which for the suction there is a free space preferably extending over the entire length into which a suction tube and/or hose connected to evacuating means 14 opens. Said evacuating means consists in paticular of a vacuum container, a sucking pump P and a valve V to prevent the penetration of ambient air. From the vacuum container a tube leads to the suction strip 13*a* and a branch 14*a* leads to an evacuated space separated in air-tight manner on all sides by means of a partition 16 and located above the electrolyte surface 9' behind the porous side wall 5 for extracting the hydrogen gas $H_2$ also liberated there.

Disposed beneath the suction strip 13*a* is a further suction strip 13 which lies beneath the electrolyte level 9'. From this suction strip a tube 35*g* leads to a degassing container 35 which on the basis of the principle of communicating tubes is also filled with electrolyte up to the same level 9', an empty space remaining above the electrolyte surface and said space also being connected to the evacuating means 14. A suction tube 35*h* opens into the degassing container 35 beneath the electrolyte level 9' via a valve V which is connected via further tubes 35*d* and 35*e* to a liquid pump which opens into a further degassing container 35'. This degassing container also comprises a free space above the electrolyte level which communicates with the evacuating means 14 via a conduit 14*b*. The outlet of the degassing container 35' is connected via a tube 35*e* starting beneath the electrolyte level and a further tube 35*f* to the upper region of the electroplating container 1, the electrolyte freed from gases being returned via said tube 35*f* to the electrolyte container 1.

The lowermost suction strip 13' is connected via a tube 35*a* through a check valve V to a tube 35*d* which also opens into the suction line 35*e* of the liquid pump F1P. In this manner, hydrogen bubbles forming at the article to be electroplated are sucked off immediately and this is further promoted by a grooved surface of the porous wall 5. The electrolyte coming into contact with the surface to be electroplated is continuously replenished via the suction strips 13 and 13' and consequently fresh electrolyte of low gas content enriched with dischargeable metal ions is continuously brought to the surface to be electroplated. Corresponding to the length of the suction strips a plurality of suction tubes 14', 35*g* and 35*a* may be provided which open into manifolds as indicated at 35*c* for example in FIG. 1.

Furthermore, a second evacuating means 15 is provided whose suction tube 15a opens into the space above the electrolyte level 9 on the side of the partition 16 opposite the porous wall 5. Said evacuating means 15 also include a vacuum chamber, a suction pump P and a valve V for separate exhausting of the second part of the electroplating container separated by the partition 16, in which the anodes 18 are disposed. The partition 16 and the separate evacuating means 14 and 15 exclude any mixing of the separated hydrogen with the separated oxygen and thus any danger of the formation of highly explosive oxyhydrogen gas.

It is also advantageous to make the surface of the porous side wall 5 corrugated in the direction of the pile 17 so that the hydrogen gas liberated directly at the electroplating surface can escape along the shortest route out of the electrolyte due to its expansion and the absence of the atmospheric pressure and prevention of the action of adhesive forces of the porous wall.

The adhesive and cohesive forces which originate from the article to be electroplated and the depositing metal ions are also further cancelled out by the vibration of the support frame.

The dissolving of the hydrogen gas in the electrolyte, in particular at the metal surface to be electroplated, and the resulting difficulty of the access of the metal ions is also substantially reduced because the osmotic pressure of the dissolving hydrogen is not opposed by the counter pressure of other dissolved gases and the atmospheric pressure.

To vent the space above the electrolyte surface 9 after completion of the electroplating operation and for emptying the electroplating container vent tubes 24', 24'' and a vent clock 24 are provided.

Figure 3:
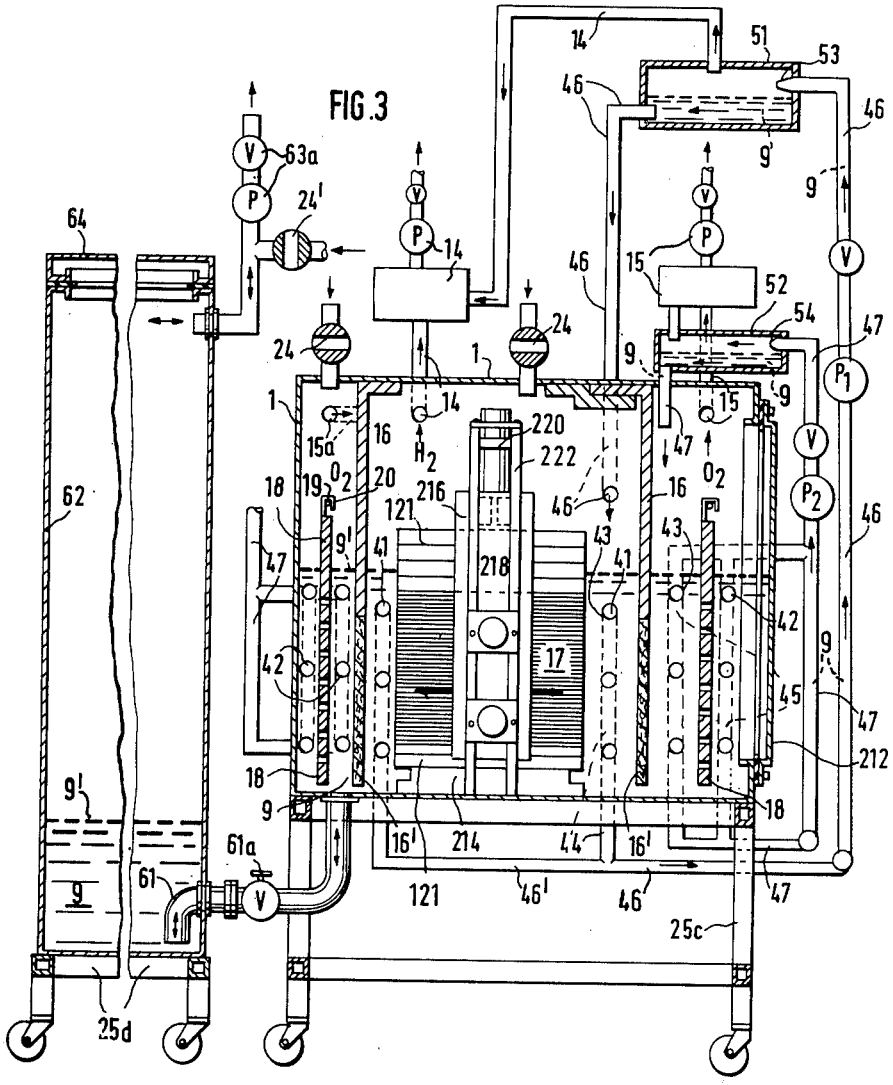
FIG. 3 is a modified embodiment of the apparatus in which the article to be electroplated is introduced into the electroplating container.

FIG. 3 illustrates a further embodiment of the electroplating apparatus in which the article to be electroplated, which in this case also consists of a pile 17 of stacked metal panels of equal dimension, is introduced completely into an electroplating container 1 which is fully sealed and has a cover 212 in one of its side walls for introducing the article to be electroplated, of course, this cover may also be in an upper side wall of the electroplating container 1. On both sides of the pile 17 there are partitions 16 which if necessary are removeable to permit the introduction of the sheet metal panel pile 17. These partitions divide the air space above the electrolyte surface 9' into regions in which hydrogen or oxygen are separated. In the embodiment illustrated there are thus three areas which are connected to the evacuating means 14, 15 in such a manner that a separation of the hydrogen and oxygen gases is effected and mixing to form detonating gas impossible.

If a plurality of separate spaces is provided for receiving one and the same gas, such as for example oxygen gas, above the anodes 18 they may be connected to a common evacuating means for example 15 via branch tubes. It is expedient to dimension the capacities of the evacuating means and the flow resistance of the branch tubes in proportion to the different volumes of the cavities to be evacuated so that on evacuation the pressure drops uniformly in all the space areas. The air valves 24 through which the air is readmitted to the electroplating container on completion of the electroplating may all be connected to each other.

In FIG. 3 a supply container 62 is also shown in which the electrolyte can be kept. An evacuating means 63*a* is also associated with this supply container and permits the electrolyte to be freed during its residence in the supply container from all gases by evacuation of the air-tight sealed space above the electrolyte surface. As a result, the electrolyte is in an optimum condition before it is transferred to the electroplating container. The transfer of the electrolyte from the supply container 62 to the electroplating container 1 is effected by opening the air valve 24' at the supply container and the connecting valve 61*a* in the connecting tube 61, whereupon the partial vacuum in the electroplating container 1 evacuated by the evacuating means 14 and 15 causes the electrolyte to pass to the electroplating container 1.

To pump the electrolyte back to the supply container 62 the air valves 24 of the electroplating container 1 are opened and the evacuating means 63*a* of the supply container 62 set in operation. Consequently, the electrolyte is subjected to atmospheric temperature only temporarily during its short passage time from the one container to the other. However, during this short time the electrolyte only absorbs negligible quantities of air.

The partitions 16 are formed within the electrolyte 9 as porous partitions 16' and extended towards the bottom of the electroplating container 1. Said porous partitions 16' consist of a material which does not disturb the electrical field of force. The porosity is so dimensioned that even on motion of the electrolyte on both sides of said porous partitions 16' said electrolyte cannot pass from one side to the other.

Such a motion of the electrolyte may for example be produced by providing in the various electrolyte areas (anode or cathode) separate grid-like tube means with horizontal suction tubes 41 or 42 and opening 43 directed perpendicularly against the electrode surfaces, for example perforations, slits or the like, through which the used electrolyte is sucked substantially perpendicularly from the electrode surface so that the layer renewal (diffusion layer, phase boundary) takes place by unused electrolyte flowing between the tubes likewise perpendicularly to the electrode surfaces on the latter. The plurality of the suction tubes disposed beneath each other is connected at the two ends to vertical tubes 44 and 45 so that the suction takes place from both sides of the horizontal tubes. The perpendicular tubes 44 and 45 are in turn connected to communication tubes 46 and 47 which are connected to a suction pump $P_1$ and $P_2$ respectively. The latter sucks up the electrolyte disposed in the tubes 41 and 42 and supplies it to a degassing container 51 and 52 in which the electrolyte is further freed from gases. The electrolyte freed from gases is then supplied via tubes to the respective regions of the electroplating container. Thus, at any point in time the amount of electrolyte extracted from the electroplating container 1 is equal to that supplied thereto. The amounts extracted from the individual areas are adapted to each other in such a manner that there is no possibility of electrolyte passing through the porous partitions 16' from one region to the other. Instead of porous partitions other dividing means which fulfill the same function may be provided.

To free the electrolyte from gases more rapidly the degassing containers 51 and 52 may be provided with wide-area spray nozzles 53 and 54 to which the electrolyte is supplied by the pumps $P_1$ and $P_2$ by the valves V.

In FIG. 3 only the circulating means for the right-hand half of the electroplating container, which contains the anode electrode 18, are shown. Of course, corresponding circulating means are also provided in the left half in FIG. 3 and for example the tubes 47 of the left half of the electroplating container may also open into the same degassing container 51 or into an additional degassing container. Obviously, evacuating means 15 provided for the right half of the anode space for the space above the anodes in the left half of FIG. 3 are also provided above this left anode space and the suction conduits 15*a* of these two anode spaces may be connected together so that only a single evacuating means is necessary.

In FIG. 3 two planar partitions 16 and 16' are shown. Of course, the partitions may have a different form if expedient because of the article to be electroplated or the container.

The flow path and approach of fresh electrolyte at the anode and cathode electrodes may be improved by arranging the suction tubes 41, 42 as near as possible to the surfaces of said electrodes so that only a small gap remains between said tubes and the electrode surfaces. Furthermore, it is advantageously possible to perforate the anode electrodes and the suction can then take place from the back of the anode sheets. This extraction from the back removes the used electrode layers through the perforations to the rear of the anode electrode along the shortest path.

The circulation of the electrolyte combined with the extraction of the gases formed during the electroplating operation enables fresh quantities of electrolyte comprising a large number of dischargeable ions to reach the surface to be electroplated along the shortest path. This makes it possible to produce the conditions necessary for a fine-crystalline and smooth continuous dense thick layer of maximum bonding power in the phase boundary.

The article to be electroplated shown in FIG. 3 consists of a pile 17 of sheet metal panels of equal dimensions in laminate array and is stacked on a stack plate 214, wooden plates 121 possibly being added to said pile above and beneath the latter so that the total height of the sheet panel pile and its supplementary plates is always substantially the same. To effect contacting with metal panels having an insulating coating on one or both sides contact brushes (not illustrated) are provided which are disposed in insulating housings 216, the latter being pressed via pressure cylinders 218 against a face formed by the edges of the metal panels. The pressure cylinders are mounted in a vertical framework 222. To avoid the contact brushes concealing a portion of the metal surface to be electroplated during the electroplating said brushes are displaceable as indicated by the arrow together with their housing 216, the pressure cylinders 218 and the framework 222 in the horizontal direction in horizontal guide rails (not illustrated) along the surface of the pile of sheet panels. The contact brushes may for example be set in vibration by AC magnets to ensure permanent contact with all the individual panels. The housing 216 is sealed with sealing means with respect to the panel pile and via a valve 220 compressed air can be introduced into said housing to prevent penetration of the electrolyte into said housing 216.

Figure 4:
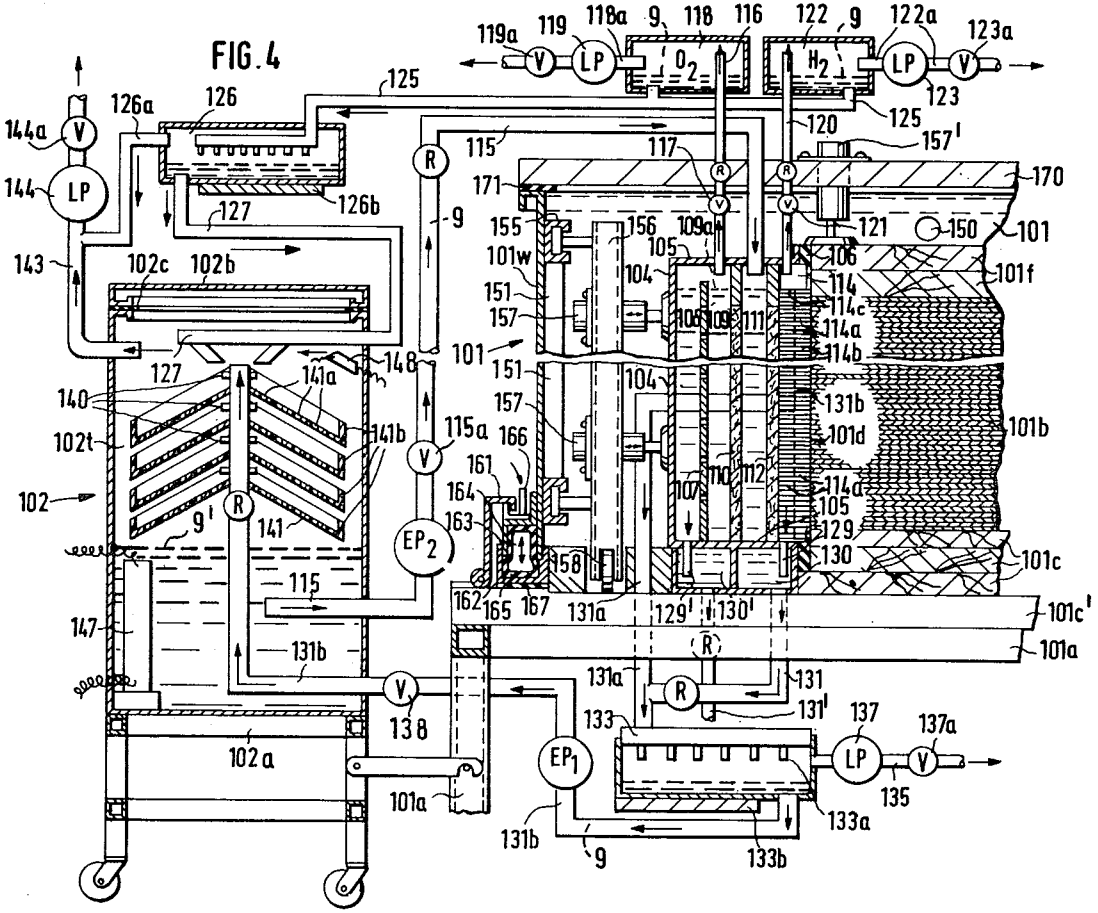
FIG. 4 is a further embodiment of the apparatus comprising an electroplating strip.

FIG. 4 shows diagramatically in vertical section an electroplating apparatus 101 and an electrolyte container 102 with the conduits connecting them. The electroplating apparatus 101 comprises a travelling table 101*a* which carries a pile 101*b* of sheet metal panels on fixed or oscillatable plates 101*c*, the side faces thereof forming for example perpendicular planes 1*d*. The drawing shows a moveable electroplating housing 104 which is associated with a pile face 101*d* and consists of a partially firm and partially resiliently flexible enclosure 105 which in particular comprises a sealing strip 106 which bears on the pile face 101*d* in the manner of a frame and is resilient, consisting for example of rubber. Disposed in this electroplating strip in the left portion are anode plates 107 or anode rods 107. The plates 107 are preferably perforated. In the case of anode rods, free intervals are left between them. Behind and in front of said anodes are free spaces 108 and 109 for receiving the electrolyte. Further to the right towards the pile is a porous partition 110 which is continuous from the top to the bottom and subdivides the strip 104 perpendicularly, the porosity of said partition being such that preferably the electrolyte can pass from one side to the other of said partition 110 only under the action of pressure or suction. In contrast, the migrating ions can pass unrestricted under the action of the electric field through said porous wall 110.

Spaced from this porous wall, to form a free space 111, is a second porous wall 112 of substantially the same nature as the porous wall 110. Said wall 112 is intended to prevent electrolyte enriched with dissolved hydrogen from passing from the cathode chamber 114 between said wall 112 and the cathode or the pile face 101*d* to be electroplated into the intermediate space 111 between the two partitions 110 and 112. This stops the electrolyte with dissolved hydrogen for mixing with electrolyte with dissolved oxygen, which would produce a detonating gas mixture of highly explosive nature in the electrolyte degassing.

A completely gas-free electrolyte of optimum composition is conducted from the electrolyte container 102 into the intermediate space between the porous partitions 110 and 112 continuously via a moveable hose or a tube 115 preferably under predetermined pressure. Said electrolyte goes through two porous walls 110 and 112 partially in the direction of the anodes 107 and partially in the direction towards the cathode face 101*d*. Because of the pressure in two opposite directions the passing of the electrolyte disposed in the anode chamber 109 into the intermediate space 111 and conversely the passing of the electrolyte with dissolved hydrogen from the cathode space 114 in front of the pile face into the intermediate space 111 is impossible.

A moveable hose 116 leads to above the anode chamber 109 and communicates permanently for example via a valve 117 with a vacuum vessel 118. As a result the space above the electrolyte surface 109*a* becomes a vacuum. The oxygen molecules separating at the anodes 107 will free themselves from the anode against the adhesive forces of the latter, rise into the pipe 116 and via the valve 117 are led off into the vacuum vessel 118 and the air pump 119 with valve 119*a* connected thereto by a tube 118*a*. This removes a considerable portion of the oxygen liberated at the anodes 107 from the anode chambers 108 and 109. The formation of a concentration polarization by accumulation of metal ions at the anode is also largely prevented. The metal ions are more able to move freely in the direction towards the cathode through the two partitions 110 and 112. This requires however that in the same manner there is no concentration polarization or diffusion layer at the metal-electrolyte phase boundary 101*d*. The migration of the oppositely charged ions from the one electrode to the other increases with the concentration of dischargeable ions with the minimum possible concentration polarization. The microspread force and the levelling out depend on this.

To enable the hydrogen ions depositing on the cathode in addition to the metal ions to detach themselves in gaseous form rapidly against the adhesive forces of the cathode, the outer surface of a porous wall 114*a* disposed in the cathode chamber 114 is provided with perpendicular corrugations 114*b*. The hydrogen molecules rise in the gaseous state in the corrugation depressions. To promote this rising the space above the electrolyte surface 114*c* is a partial vacuum, which is achieved in that as is the case above the electrolyte surface 109*a* a hose 120 communicating via a valve 121 with a vacuum vessel 122 is arranged. The vacuum vessel 122 is continuously freed from the hydrogen gas $H_2$ entering with the aid of an air pump 123 via a tube 122*a* and the vacuum is secured by a valve 123*a*.

The corrugated porous layer 114*b* bearing on the cathode 101*d* may consist of a plurality of horizontally extending similarly corrugated individual layers supplementing each other in the vertical direction. The individual horizontal layers may be of different electrolyte permeability to obtain maximum uniformity of the electrolyte sheet on the electroplating surface during the reciprocating motion of the electroplating strip.

Disposed at the bottom of the cathode chamber 114 is a drainpipe 129 which allows the electrolyte to flow from the cathode chamber 114 downwardly into an air-tight collection container 130 and from the latter into a drainpipe 131 or hose.

A perpendicular tube 131*a* opens into said drainpipe 131. This tube 131*a* comprises right-angled horizontal cross tubes 131*b* which project from outside into the covered chamber 114 of the electroplating strip. Such cross tubes 131*b* may lead as required in any desired number — originating from the perpendicular tube 131*a* — into the cathode chamber 114 and thus allow the used electrolyte to be removed at optimum vertical intervals from the cathode chamber. This prevents the lower portion of the cathode chamber from being continuously filled with used electrolyte, as when if only the drainpipe 129 were present. This would slow down the migration of the ions in the lower portion with respect to the upper portion.

This electrolyte is then conducted into a lower degassing means 133 which via nozzles 133*a* conduct the electrolyte ejected and thus freed from hydrogen gas in the lower apparatus chamber via drain tubes to a suction pump ($EP_1$). Above the liquid level of the degassing apparatus an evacuating tube 135 enters which is connected to an evacuating means, an air pump 137 and a valve 137*a*. This removes the liberated hydrogen. The at least partly purified and degassed electrolyte is conducted via the electrolyte pump $EP_1$ and the intermediate valve 138 through the tube 131*b* and the lower portion of the evacuated electrolyte supply container 102 in the latter perpendicularly to its upper evacuated portion lying above the electrolyte surface.

This end section of the tube 131*b* carries at its upper end lateral openings or nozzles 140. The tube end itself is also open. Associated with said lateral openings 140 are inclined faces 141 for example of plastic with perforations 141*a* and perpendicular end limits 141*b*. The electrolyte flowing on to said inclined faces faces flows downwardly and seeps through the perforations onto the next-lower inclined face which is constructed in the same manner. Such inclined faces may be associated with each other in any desired number so that an appreciable is required for the liquid to reach the lower container. During this time the electrolyte is freed from any gases possibly still dissolved therein by the fine distribution of said electrolyte onto the surfaces and the dripping through the vacuum. For this purpose, the upper portion of the electrolyte supply container 102 disposed on a travelling table 102*a* is connected via a tube 143 to an air pump 144 and a valve 144*a*, whereby a vacuum can be maintained within the supply container. For this purpose the cover 102*b* is also air-tight by means of a seal 102*c*.

The manner in which the cathode chamber 114 via the lower drain tube 129 and the following tubes and means and via the tube 131*a* with the cross tubes 131*b* returns the used electrolyte via a degassing means 133 and 141 to the electrolyte container 102 is also adopted for the used electrolyte in the anode space 108 behind the perforated anode plates 107 or with anode rods in spaced relationship which under the action of the fresh electrolyte flowing from the intermediate space 111 are kept free from polarization layers by suction cross tubes (not illustrated) projecting into the anode cathode 108. FIG. 4 shows only a lower drain tube 129' with drain tube 131 and an air-tight collecting wall 130'. Since all the other tubes and means are identical and for example lie parallel to each other they are concealed. It would therefore be superfluous to draw them.

It is however pointed out that the electrolyte container 102 is subdivided substantially in the centre perpendicularly in air-tight manner by a partition 102*t*. In this second portion of the supply container identical degassing means to those designated by 141 are provided. This makes it possible not only to lead off the used electrolytes completely separated from each other but also to supply them separately to the electrolyte container for further degassing and remove them outwardly separately via a further air pump. The partition 102*t* may be perforated in the lower portion in which the electrolyte is located or have incisions so that the purified electrolyte in the two chambers is in communication. The purified electrolyte may then be supplied in the manner described from one of the two chambers via a tube 115, an electrolyte pump $EP_2$ and a valve 115*a* to the receiving chamber 111 of the electroplating strip between the porous partitions 109 and 112.

There is thus a circulation of the electrolyte whose pressure in the electroplating strip can be adjusted by regulating means depending on the requirement. This intended firstly to control the quantity of electrode supplied by the electroplating strip to the anode and cathode surfaces and secondly in conjunction with the electrolyte pump $EP_1$ to increase the flow velocity through the electroplating strip or against the electrode surfaces thereof in such a manner that no diffusion and concentration polarization layers or similar disadvantages phenomena can occur. Due to the kinetic energy of the flowing electrolyte a continuous interchange of the layers at the electrode surfaces occurs.

Thus, the requirements for high quality of the deposits are largely fulfilled in the electroplating strip itself. FIG. 4 shows in the upper portion at the evacuated space 122 a drain tube 125 for draining the electrolyte entrained by the rising hydrogen bubbles, opening into a degassing means 126. In the latter the electrolyte is again subjected to a degassing for safety reasons. The degassing means is connected via a tube 126*a* likewise to the air pump 144 with the valve 144*a*. The electrolyte can then flow via a tube 127 to the hydrogen degassing means 141 in the electrolyte supply container 102. As for the lower drain means, for the upper vacuum chamber 118 (with additional evacuating means 119, 119*a*) as well for separating and draining the hydrogen-containing electrolyte means similar to the aforementioned means 125, 126, 127 are provided for separate degassing of the oxygen-containing electrolyte coming from the anode chamber 102.

Apart from the degassing tubes 120 and 116 provided for the rising gases separately for hydrogen and oxygen, electrolyte tubes (not illustrated) may originate from the cathode chamber 114 and open into the vacuum chamber 112 and on the other hand originate from the anode chamber 108 and open into the vacuum chamber 118 for conducting the used electrolyte into these degassing chambers 122 and 118. From the latter they are conducted by separate tubes into separate further degassing means (for hydrogen means 126) and from there as described above separately from each other into corresponding degassing chambers with the means 141 of the electrolyte supply container 102. There is thus absolute separation between the use electrolyte originating from the cathode chamber 114 and the electrolyte from the anode chamber 108. This additional separate removal of the electrolyte used by dissolved oxygen enables the fresh electrolyte flowing from the intermediate space 111 to the electrode surfaces to displace the used electrolyte along the shortest route and to be caused to separate and thus to supply to the electrodes continuously fresh electrolyte concentrated with dischargeable ions and excluding any troublesome polarizations.

The temperature of the electrolyte and also that of the article to be electroplated is of significance as regards the quality of the electroplating. For this purpose, in the electrolyte supply container 102 electrical temperature control means 147 are provided in the lower electrolyte chamber and keep the electrolyte constant at a predetermined optimum working temperature; the electrolyte is supplied at this working temperature via the tube 115 and the electrolyte pump $EP_2$, a valve 15*a* and a regulating means R to the intermediate space 111 of the electroplating strip with adjustably predetermined pressure.

FIG. 4 further shows in the upper portion of the space of the electrolyte container 102 in diagrammatic form infra-red radiators 148 which heat the inclined faces 141 and the electrolyte moving thereover. This enables a rapid and complete degassing to be achieved. Correspondingly, for example infra-red radiators may be associated with the other degassing means, e.g. 126 and 113, in suitable manner and/or heating plates 126*b* or 133*b* may be provided beneath the bottoms of said means. This may also be done with the chambers 118 and 122. This enables the electrolyte first to be brought to high temperatures for the degassing and then in the lower portion of the electrolyte supply container to be brought by the temperature control means 147 by cooling or if necessary heating to the optimum working temperature. For this purpose agitating means known per se may also be provided in the lower electrolyte-receiving portion of the electrolyte supply container. It is also possible to arrange infra-red radiators opposite the cathode surfaces 101*d* of for example the pile 101*b* to be electroplated to enable said surfaces 101*d* to be heated to an optimum temperature. The electrolyte also absorbs radiant energy and is thus advantageously brought to a greater ionisation and more rapid deposition of metal ions, as well as increased and more rapid separation of hydrogen molecules.

Radiation other than infra-red may also be used, for example ultraviolet, directed onto the electrolyte covering the surface 101*d* to be electroplated.

The porous wall 114*a, b* may be at least partially dispensed with and the liquid-tight seal of the electroplating strip 104, 105 provided by suitably constructed rims which bear with regulated pressure on the cathode surface 1*d*. The layer exchange of the used electrolyte can then be carried out faster and more intensively.

As described, the necessary laterally sealing rim portions 106 for example of rubber may be provided with fine incisions, grooves or the like to allow a predetermined quantity of electrolyte to discharge laterally. This electrolyte flowing onto the electroplating surface 101*d* due to the movement of the electric plating strip laterally thereof in the evacuated space 101 is also disposed in the electrical field between the negatively charged overall electroplating area 101*d* and the anodes 107 introduced only into the electroplating strips 104. The ions can migrate and deposits take place in the fine electrolyte layer of the cathode surface 101*d*, although also at a reduced rate. The current density varies rhythmically corresponding to the movement of the electroplating strip. To obviate greater fluctuations a plurality of electroplating strips is arranged at optimum intervals to each other corresponding to the length of the cathode surface 101*d* preferably perpendicular to the latter.

The electrolyte entering the intermediate space 111 via the pump $EP_2$ is conducted by the electrolyte pump $EP_1$ in the cathode chamber 114 and also by a further electrolyte pump EP (not shown) in the anode chamber 108 with increased velocity against the electrode surfaces. The suctions produced by the pumps may be so strong that a fluid reduced pressure is produced in the electrolyte. This promotes the electroplating operation.

Alternatively, if necessary a pressure may be provided which is required for the discharge of the electrolyte also via the vacuum chambers 111 and 122. The later need not however be above the electroplating strip but may be arranged laterally of the electroplating container 101.

All the hose and pipe lines connected to the moveable electroplating strip are flexible and/or flexibly mounted or provided with joints in such a manner that they can also execute the movement of the electroplating strips without impeding the latter.

A collection trough (not shown) (cf. for example P 17 71 645, FIG. 1, point 10) may also be provided in airtight manner for the electrolyte flowing down over the cathode face 101*d*. The electrolyte can be returned by pumps from said trough via degassing means to the electrolyte supply container 102.

Contact brushes (not illustrated) are to be associated with the pile faces 101*d* to be electroplated at suitable points, as described in Applicants' elder German applications.

For this purpose, moveable support and guide strips engaging in guide rails with rollers running therein are provided. They consist of a housing of for example insulating material, such as plastic, and a contact brush disposed therein which is pressed by compressed-air cylinders against the pile 102 at a side which for example is not being electroplated at the same time or has already been electroplated. The back, which is for example flexible, of the contact brushes may be supported by a soft rubber which is accommodated in the cavity of the housing remaining behind the brushes. The vacuum in the evacuated electroplating chamber 101 facilitates the passage of the cathode current from the brush to the cut edges. As a precaution, the contact brushes are provided with coatings on which the electrolyte metal does not deposit. This allows them to be arranged at a cathode surface simultaneously swept by an electroplating strip, with the movement of which it correspondingly supplies the cathode current. For improved contact they may be set in motion by AC magnets.

To obtain a constant termination at the bottom and top with respect to the contact housing the cover plates 101*c*, 101*f* beneath and above the pile 101*b* may be applied in a plurality of layers to a height such that the total height of the panel pile and the supplimentary plates is always constant. These contact means are optionally moveable to the individual sides.

The arrangement of the guide rails with the rollers running therein of the support and guide rails may be effected as shown in FIG. 1 at reference 155 (guide rails) and 156 (support and guide strip) with displaceable pressure cylinders 157 moveably on the side walls 101*w*. The housing receiving the contact brushes may also be made in the same manner as that of the electroplating strips 104. 105. As with the electroplating strip this contact housing is also mounted on the pressure plates of the pressure cylinders 157. The support and guide strip may be for example also be provided with lower rollers 158 and possibly upper rollers.

Instead of being attached to the side walls the guide rails may for example be provided on the cover and bottom for the rollers 158 or for example on chassis, whether disposed on the cover or bottom or connected to the plates 101*c*, 101*f*.

This applies both to the electroplating and to the contact strips.

In FIG. 4 the electroplating strip may press in liquid-tight manner with vertically bent edge portions on the cover and support plates 101*c*, 101*f* disposed flush with the electroplating surface 101*d*.

Filter means known per se may be included in the electrolyte circuit.

FIG. 4 shows diagrammatically a side wall 101*w*. The latter is advantageously a composite wall corresponding at least to the pressure requirements resulting from the evacuation of the interior which said wall surrounds. This may be achieved in any desired manner. The lower portion includes pivotal mounting means (brackets) 161. The side wall carries downwardly a U-shaped pressure strip 162 into which the side wall projects with an oppositely directed U-section 163. Inserted in the cavity 164 thus formed is an air hose 165 which is supplied with compressed air via a valve 166 and presses the U-shaped pressure strip 162 with soft rubber sealing strips 167 against the pile plate 101*c*'. The counterpressure to the air pressure in the cavity 164 is exerted by the pivotal bracket 161 which limits and prevents a lifting of the side wall upwardly. The perpendicular edge portions of the adjacent side walls are also made air-tight in this manner. This provides a frame which is air-tight all round and defined by the side walls 101*w* and the upper opening of which is also sealed in air-tight manner by a cover plate 170 which is fitted via a seal 171 on the upper angled portions of the side walls. The cavity between the side walls 101*w* of the cover plate 170 and the bottom 101*c*' may thus be evacuated. All the parts of the electroplating apparatus disposed therein are in the prescribed vacuum which is established with a tube 150 which is provided with a valve and connected to evacuating means. Of course, in for example cases in which the demands made of the quality of the electroplating are not as high, it is not necessary to provide the aforementioned side walls and a vacuum at the boundary of the electroplating apparatus.

In all the embodiments illustrated in FIGS. 1 to 4 ultrasonic transducers may be provided both in the electrolyte and at the walls of the container and at the electrodes or the article to be electroplated. It is particularly advantageous to use a plate-like ultrasonic transducer which is suspended vertically in the electroplating container, for example instead of the porous partition 16 or 16' or between the porous partitions 110, 112 according to FIG. 4. Such a ceramic plate oscillating transversely in the ultrasonic range enables the anode electrode and the surface of the article to be electroplated to be subjected simultaneously to ultransonic energy, thus obtaining the aforementioned advantages of the effects of ultrasonic energy. This ultrasonic arrangement has the further advantage that the surface to be electroplated, for example the face formed by the cut edges of panels, is cleaned of any soil such as grease as the like which may have reached the cut edges in for example the punching operation. The cleaning of these surfaces with ultrasonic energy may be so intense that for example electroplating of aluminium and similar metals having a strong tendency to oxidation is possible because the ultrasonic energy loosens the oxide layers and detaches them. In any case the ultrasonic oscillation may be pulse-like and generated with changing amplitudes which firstly saves energy without reducing the advantageous effect and secondly reduces any heating of the ultrasonic generator.

As already mentioned above, in the electroplating container and/or in the supply container temperature control means such as 147 in FIG. 4 may be provided to bring the temperature of the electrolyte to an optimum value. Said temperature control means may include cooling meand and heating means. Furthermore, cooling and heating means may be provided in the conduits leading to and from the supply container and operated possibly with constant power, the cooling and heating effect depending upon the circulating velocity of the electrolyte. In addition, it is of course possible to cool or heat the electrodes and/or the article to be electroplated to obtain optimum temperature conditions with respect to the metals used and the electrolyte.

Figure 5:
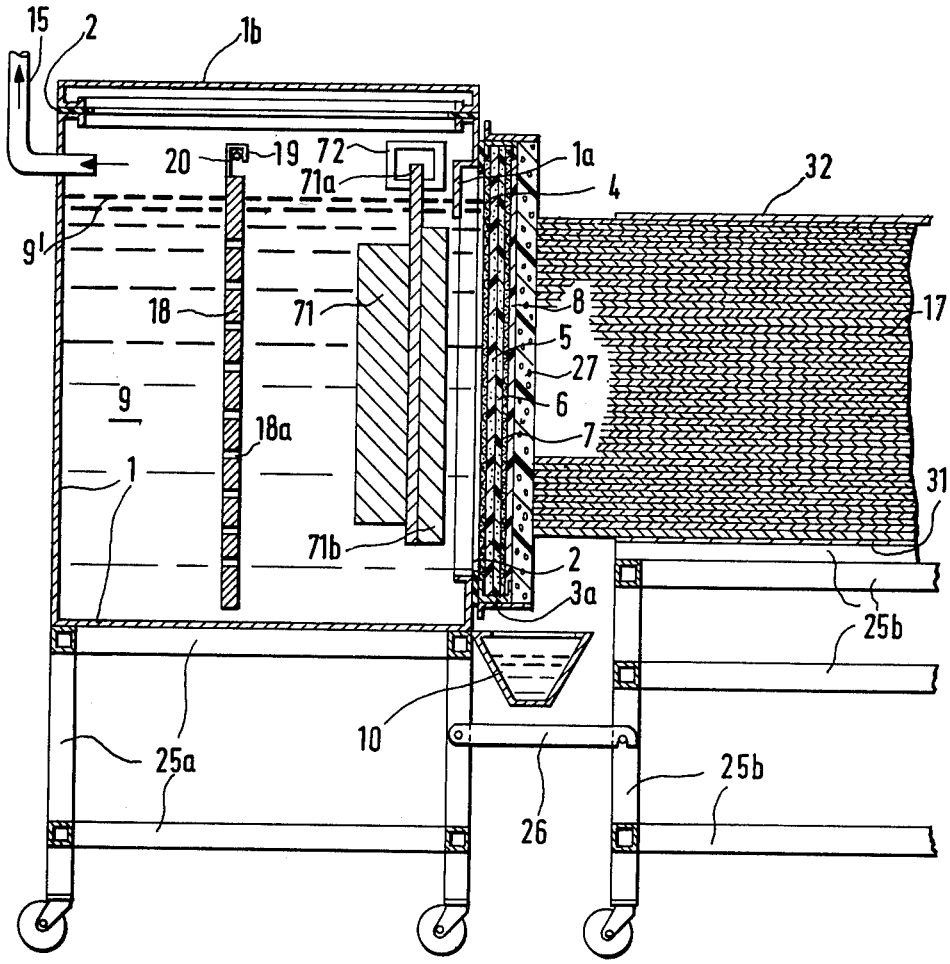

The use of ultra supersonic wave generators is described hereinafter with particular reference to FIGS. 5, 6, and 6*a*. FIG. 5 illustrates an electroplating apparatus similar to that shown in FIG. 2, and, where applicable, the same reference numerals have been used to designate the same elements. A diagrammatically illustrated supersonic wave generator 71 with a plate 71*a*, which is capable of vibrating and caused to vibrate by said supersonic wave generator 71, is provided in the electrolyte or electroplating container 1. The plate 71*a* which is capable of vibrating can be re-inforced or intensified by an additional vibrating plate 71*b* of optimum thickness. In place of a continuous plate 71*b*, there can also be placed upon plate 71*a*, for instance, vertical triangular implements, capable of vibration, at an optimum distance from each other. The plate 71*a* which is capable of vibration is fastened at its upper end to a carrier part 72, the lower legs of which engage a perforation in the plate 71*a*. The vibrating device, instead of being arranged in such a static manner, can also be attached for reciprocating motion, for instance, to guide rails or bars. The liquid between the vibrating device and the surface of the stack of plates, the edges of which are to be electroplated, is thrown into supersonic vibration by, for instance, triangular implements 71*b* capable of vibration. Due to the supersonic vibrations, cleaning of the cut edges is achieved or, for instance, when using aluminum plates, the oxide layer is removed. Suitable chemical liquids can be used for this purpose in combination with the supersonic vibrations. The action of the chemicals upon the oxide layer is not only increased by the mechanical action of the vibrations, but also by an increased activity of the molecules or, respectively, of their atomic elements. Furthermore, it is possible to use an electroplating electrolyte in combination with chemical agents by which not only de-oxidation is achieved, but also electroplating of the aluminum surfaces which are converted by said de-oxidation into pure metal surfaces. It is, of course, also possible to provide a mobile vibrating device which smashes the oxidation layer in front or behind a movable electroplating bar. If a stationary continuous plate-like vibrating device is placed into the electrolyte container 1 in accordance with FIG. 5, it is necessary to arrange for satisfactory perforations, which may be grid-like, in the vibrating device in case the same remains in the container during electroplating, so that the ions can migrate from the anode 18 to the cathode cut edges through such perforations. It is understood that for this purpose a multitude of vibrating devices must be provided with corresponding discontinuities or, respectively, passages for the electrolyte. All the parts of the vibrating device, such as, for instance, the plates 71*a*, 71*b* which are capable of vibrating or, respectively, the bars, triangular bodies, rods, or the like, which are also capable of vibrating possess inherent frequencies which correspond to the frequencies of the vibrator or oscillator, i.e. which resonate therewith. In addition to the illustrated vibrating devices the supersonic waves of which are directed preferably vertically towards the cathodic surfaces and which serve to remove, for instance, oxide or dire layers, there can be hung suspended into the electrolyte further vibrators, for instance, between the anode 18 and the vibrating device 71. Said additional vibrators deviate the supersonic wave vibrations in the direction towards the anode as well as in the opposite direction towards the cathode on both sides. As a result thereof, formation of small bubbles at the electrode and within the electrolyte, i.e. the separation of gases which are dissolved therein or, respectively, which are set free at the electrodes, is very considerably promoted and increased.

It is, of course, understood that the vibrating devices 71 can vibrate not only in the direction toward the cathode surface, but also in the direction towards the anodes 18. Further vibrators can be arranged, for instance, at the bottom of the electrolyte container 1 or underneath said bottom. As a result thereof, a vertically upwardly directed supersonic wave propagation or fanning out is achieved causing acceleration of the bubbles ascending in the same direction and removal thereof from the electrolyte. The electrodes themselves, of course, can be exposed to the ultra-sonic waves from various directions depending upon the requirements, for instance, from combined directions. In all these instances the vibration energy as well as the frequencies, amplitudes, and the like, are to be developed under optimum conditions depending upon the desired effect. It is known that even the smallest particles cause cavitations at the electrode and especially at the cathode. This fact is of special importance in the present case for eliminating the oxide layers, for instance, an aluminum plates or other strongly oxidizing metal plates. The surface of such oxidized metal plates are to be pretreated accordingly, for instance, by roughing them. Thereby care is to be taken that the frequencies are within such range that the cavitations and amplitudes can be provided to an optimum degree. Cavitations and amplitudes decrease if the frequencies are too high. The formation of bubbles is also eliminated under certain circumstances at too high a frequency because the time required for forming the bubbles is no more available. Shock waves may also be employed as they are caused by supersonic impulses with corresponding discontinuation intervals. The de-gasifying devices illustrated in FIGS. 1 to 4 and the injection nozzles discharging thereinto can also be exposed with advantage to supersonic vibrations whereby de-gasification is effected to an even higher extent. An increase in temperature encountered when employing the supersonic vibration treatment is to be prevented, if necessary, by providing corresponding cooling devices. In this instance it is of advantage to provide cooling devices especially for the electrolyte and the supersonic wave generator in the electrolyte. Advantageously and additionally the electrolyte can be cooled in the storage container and, if required, on passing through the connecting pipe between the electrolyte container and the storage container. The effects of the supersonic waves can be considerably improved by producing a vacuum because then the atmospheric pressure exerted upon the electrolyte is eliminated. Furthermore, it may be pointed out that the gas molecules cohesively enclosed in the cathodic metal surfaces, the cut edges, and the like, are set free by exposing the same to the action of ultrasonic vibration. Coupling of the ultrasonic wave energy and as a result thereof its transfer to the electrodes is achieved by the liquids between the vibrators and the electrodes. It is, however, also possible to provide vibrating devices which effect ultrasonic wave treatment electro-acoustically without contacting and without interposed liquid.

It is, furthermore, also possible with great advantage in the case of the embodiments of the present invention comprising an electrolyte container with a porous liquid permeable wall, to impinge the porous separating walls with ultrasonic wave radiation so that they are caused to vibrate or pulsate and to effect elimination of to oxide layer at the cathodic surface, for instance, of an oxidized aluminum plate due to friction.

The triangular bars 71*b* can also be shaped as hollow bodies with thin walls. Said hollow bodies effect resonance vibrations with the vibrator 71. The interposed plate or bar 71*a* can serve for transmitting the vibrations. The implements to be placed upon the front side of the triangular bars 71*b* can be shaped and of a type in accordance with the functions which they are to fulfill under optimum conditions. A fluid or the electrolyte can be placed between the triangular bars, or, respectively, the implements and the cathodic surfaces. Said fluid may have suspended therein abrasive granules, for instance, composed of silicon carbide.

Figure 6:
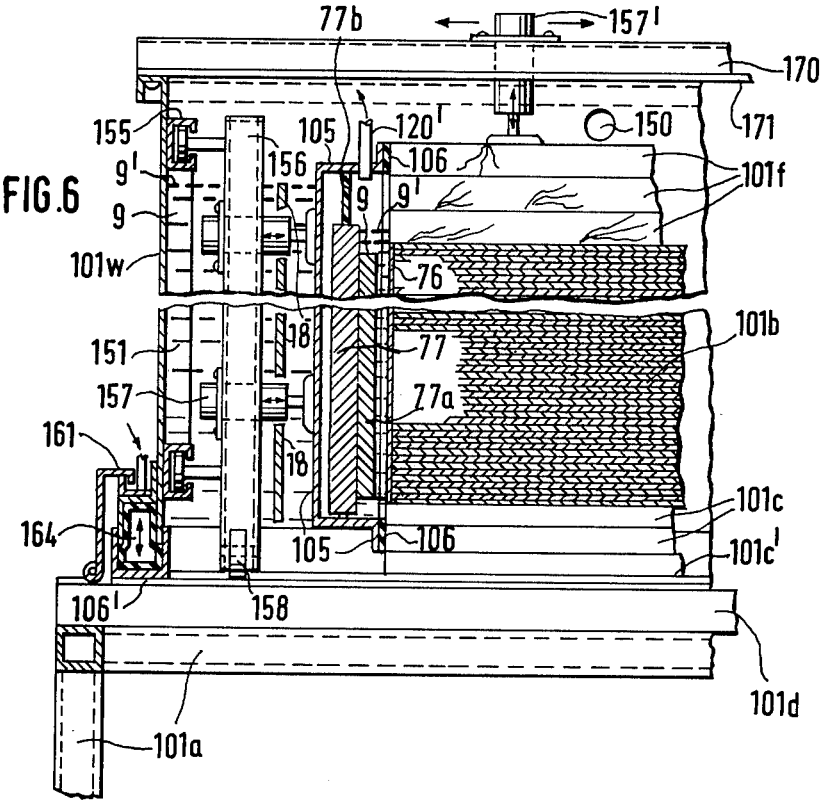
Figure 6A:
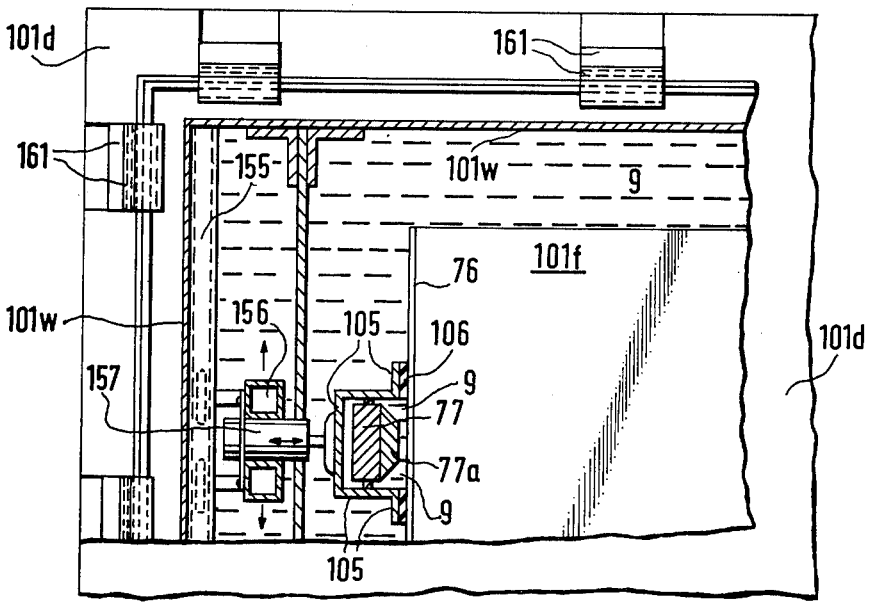

The application of a supersonic wave vibrator to an electroplating device according to the present invention as it is shown in FIG. 4 is illustrated in FIGS. 6 and 6*a*. Where appropriate, the same reference numerals are used in FIGS. 6 and 6*a* for corresponding parts illustrated in FIG. 4. FIG. 6*a* represents a horizontal cross-section through FIG. 6 at a plane through the pressure cylinder 157 of FIG. 6. As it is seen from FIG. 6, ledge or bar-like housings 105 are pressed by way of sealing means 106 upon articles to be electroplated in the shape, for instance, of a stack of plates 101*b*. In this case the stack of plates is, if required, supplemented by wooden plates 101*c* or 101*f*, in order to attain a constant height of the stack which is pressed together by means of pressure cylinders 157' so as to prevent penetration of the electrolyte or the like between the stacked plates. One or several of such ledge-, border-, or bar-shaped housings 105 are provided, for instance, side by side or at a distance from each other on the surface to be electroplated. When using a single housing 105, said housing can be movable, for instance, in horizontal direction in guide rails 155 along the surface to be electroplated whereby the housing 155 is pressed by means of pressure cylinders 157 which are attached to a support or scaffold 156, to the surface to be electroplated. Vibrating devices 77 and 77*a* are in the form shown arranged within the housings 105. The vibrating devices may be adapted to the cathodic shape of the object to be electroplated as it is used each time. An oxide layer 76 of the surface to be electroplated is schematically illustrated in the drawings. When constructing the housing 105 at the same time as an electroplating bar, there are provided additionally corresponding anode electrodes in the housing 105, for instance, in a fluid-tight subdivided hollow space. Supply devices and devices for removing the electrolyte and/or, if required, other liquids by suction as well as sieves, filters and the like can be arranged in the bar-shaped housing 105 so that continued passage of the electrolyte and/or other fluids is assured. On the other hand, it is also possible as in FIG. 4 (see also FIG. 2 and FIG. 5), to fill the entire electrolyte container 101*w* with an electrolyte and/or another fluid and to use the housing 105, which may consist of plastic walls, merely as means for contacting the surface to be electroplated and/or for cleaning said surface whereby anode electrodes of any desired arrangement can be provided in the electrolyte container. In order to improve the cleaning effect, the housing 105 can furthermore be supplied with a fluid in which abrasive granules, for instance, of silicon carbide are suspended, whereby preferably a supply and withdrawal means are provided. The vibrating bar 77*a* can, for instance, be shaped in triangular form whereby the vertex abuts the oxide layer 76. Or there can be provided a space between said bars 77*a* and the surface to be electroplated, said space being filled by the liquid in the housing 105 and/or container 101*w*. Furthermore, sieves can be provided in the ledge or bar-shaped housing 105, said sieves and/or filters enabling separation of the electrolyte to be removed by suction or any other liquid from the abrasive granules, and/or the removed oxides from a common or separate, for instance, subdivided housing space. It is, of course, also possible to arrange anode electrodes as well as supersonic wave vibrating devices in a single bar-shaped housing 105 instead of a multiplicity of separate movable bar-shaped housings which are arranged, for instance, side by side by means of suitable implements positively fastened thereto. For instance, the implements can be pointed or triangular and can be composed of suitably hard material. In this case the electrolyte content of the housing can contain at the same time abrasive granules so that electroplating can take place simultaneously during de-oxidation.

First, for instance, zinc as well as copper electroplating can be carried out on aluminum plates preferably after or even during de-oxidation and if required, other metals such as nickel or chromium can be applied thereto, if required, by electroplating.

Processing of the oxidized plate as well as the electroplating thus takes place without any intermediate removal of the plates from the electroplating device so that no air or, respectively, oxygen can reach the surface to be electroplated between the step of de-oxidation and of electroplating. The thin-walled implements on the face side of the vibrating devices 77*a* or 77*b* are provided in an optimum manner depending upon the type of material and its shape in order to remove or disintegrate the oxide layer. The implement can have, for instance, a concave working surface when placed at a sufficient and precise distance and can effect de-oxidiation for cleaning by linear focusing.

The electroplating or cleaning effect on the surface to be electroplated can be increased, if desired, by evacuating the bar or ledge. It is also possible, when using a closed electrolyte container 101*w* to carry out complete evacuation of the electrolyte container above the electrolyte level. In addition to separate supply and discharge means there can also be provided separate storage containers with filters to supply a multitude of movable housing bars or edges.

It should be noted that the partition 16 is composed of different parts. The upper part 16 consists of non-porous material and thus separates the hydrogen developed at the cathode from the oxygen developed at the anode. The lower part 16' of said partition is of porous material to permit flow of the ions to be deposited therethrough.

I claim:

1. Apparatus for electroplating articles comprising a substantially sealed electrolyte container and an evacuating means for evacuating the space above the electrolyte surface in the electrolyte container, and anode and cathode electrodes, characterized in that the electrolyte container is subdivided by porous partition means in the upper portion of said container for maintaining anode and cathode gas spaces that separate gas extraction means are provided for said gas spaces and that electrolyte extraction, degassing and supply means are provided via which the electrolyte is extracted, degassed and return to the cathode and anode gas spaces.

2. Apparatus according to claim 1, characterized in that separate electrolyte suction and supply means are provided, that the extraction or suction means are connected to separate degassing means and that the electrolyte freed from gases in the degassing means is conducted into a storage container, and that the electrolyte supply means are fed from said storage container.

3. Apparatus according to claim 2, characterized in that further degassing means is provided in the supply container for the electrolyte disposed therein.

4. Apparatus according to claim 1, characterized in that the electrolyte extraction means from the cathode and anode gas spaces open into degassing means formed by vacuum vessels in which the gas formed is separated from entrained electrolyte constituents.

5. Apparatus according to claim 1, further including means for oscillating the anode electrode and/or the cathode electrode.

6. Apparatus according to claim 5, characterized in that said oscillating means produce ultrasonic vibrations.

7. Apparatus according to claim 2, further including means for oscillating the electrolyte in the supply container.

8. Apparatus according to claim 2, characterized in that the electroplating container is an electroplating housing arranged moveably over the metal surface to be electroplated and the open side face of which is smaller than the surface to be electroplated, that in the electroplating housing at least one porous partition is provided which is parallel to the metal surface and is disposed between the anode electrode and the metal surface to be electroplated, and that in the electroplating housing a permanent electrolyte flow is maintained by the electrolyte suction and supply means.

9. Apparatus according to claim 8, characterized in that the open side face of the electroplating container is covered by a porous wall which comprises a surface provided with vertical corrugated recesses and directed towards the metal surface to be electroplated.

10. Apparatus according to claim 9, characterized in that in addition to the perpendicularly corrugated recesses substantially horizontal recesses intersecting therewith are provided.

11. Apparatus according to claim 8, characterized in that the electroplating housing is moveable with the aid of horizontal guide means along the metal surface to be electroplated and is adapted to be pressed against said metal surface with the aid of pressure means.

12. Apparatus according to claim 8, characterized in that the anode electrodes are made porous.

13. Apparatus according to claim 6, characterized in that the ultrasonic oscillations are generated by a plate-like ultrasonic oscillator which is disposed between the anode electrode and the surface to be electroplated.

14. Apparatus according to claim 13, characterized in that the ultrasonic oscillations are pulse-like and/or generated with varying amplitude.

15. Apparatus according to claim 2, further including connecting tubes between said electroplating container and said supply container for the electrolyte, and further including heating and cooling means associated with said tubes by which the electrolyte can be brought to the particular optimum temperature.

16. Apparatus according to claim 15, further including thermostatic control means for regulating the electrolyte temperature in the electroplating container and/or the supply container.

17. Apparatus according to claim 1, characterized by the feature, that the anode is subdivided into a corresponding number of horizontal part elements which are insulated with respect to each other and that different tensions are supplied to each single part element.

18. Apparatus according to claim 17, characterized by the feature that the separate parts of the anode are exposed to tensions decreasing from the top towards the bottom.

19. Apparatus according to claim 13 characterized by the feature that said ultrasonic oscillator is connected to a plate which can be vibrated and that shaped implements capable of vibration are arranged on the free surface of said plate.

20. Apparatus according to claim 19 further including means for moving the vibrating arrangement formed by the ultrasonic wave vibrator, the vibrating plate, and the implements capable of vibration in a horizontal, back and forth, direction.

21. Apparatus according to claim 20, characterized by the feature, that the vibrating device is provided with perforations for the passage of the electrolyte.

22. Apparatus according to claim 9, characterized by the feature, that a supersonic wave vibrating device is arranged behind said porous wall, said vibrating device causing the porous wall to vibrate thus effecting friction or rubbing of said porous wall on the surface to be electroplated.

23. Apparatus according to claim 1 further including supersonic wave vibration means for an electrolyte having abrasive bodies, thereby effecting purification as well as abrasion of the surface to be electroplated.

24. Apparatus according to claim 19 further including a plurality of movable housing means for containing said vibrating plate and said implements, whereby said housings can be moved with respect to the surfaces to be electroplated.

25. Apparatus according to claim 19, characterized by the feature that said vibrating means are shaped in tapered linear form and that they carry on their face side positively connected implements.

26. Apparatus according to claim 19, characterized by the feature that said implements are provided with concave front surfaces which permit linear focusing of the ultrasonic waves upon the article to be electroplated, in order to effect de-oxidation.

* * * * *